United States Patent [19]

Clarke

[11] 4,142,332

[45] Mar. 6, 1979

[54] DRILL GRINDING FIXTURE

[76] Inventor: Edmond C. Clarke, 103 River Rd., P.O. Box 275, Orange Park, Fla. 32073

[21] Appl. No.: 838,470

[22] Filed: Oct. 3, 1977

[51] Int. Cl.[2] ..... B24B 3/26

[52] U.S. Cl. ..... 51/125; 51/219 R

[58] Field of Search ..... 51/219 R, 125, 125.5

[56] References Cited

U.S. PATENT DOCUMENTS

| | | | |
|---|---|---|---|
| 1,989,835 | 2/1935 | Weishampel | 51/219 R |
| 2,401,471 | 6/1946 | Fendring | 51/219 |
| 2,411,609 | 11/1946 | Zenick | 51/219 R |
| 2,583,159 | 1/1952 | Swanson | 51/219 R |
| 2,723,510 | 11/1955 | Clarke | 51/219 R |
| 3,374,587 | 3/1968 | Simpkins | 51/219 R |

*Primary Examiner*—Harold D. Whitehead
*Attorney, Agent, or Firm*—George H. Baldwin; Arthur G. Yeager

[57] ABSTRACT

A drill grinding fixture for drills of between about 1/16 to ½ inch diameter, including an inclined trough member for receiving the drill to project from the forward end of the trough member toward the vertical face of a grinding wheel. The trough member is rotatable on a vertical pin of which the axis is offset ⅛ inch to the left of the bottom of the V-shaped trough, the pin being located between about ½ and ¾ of an inch in front of the wheel face. The trough member is provided with a recess to receive a drill holder which is rockable about the axis of the drill to present one and the other cutting lip of the drill for grinding.

4 Claims, 11 Drawing Figures

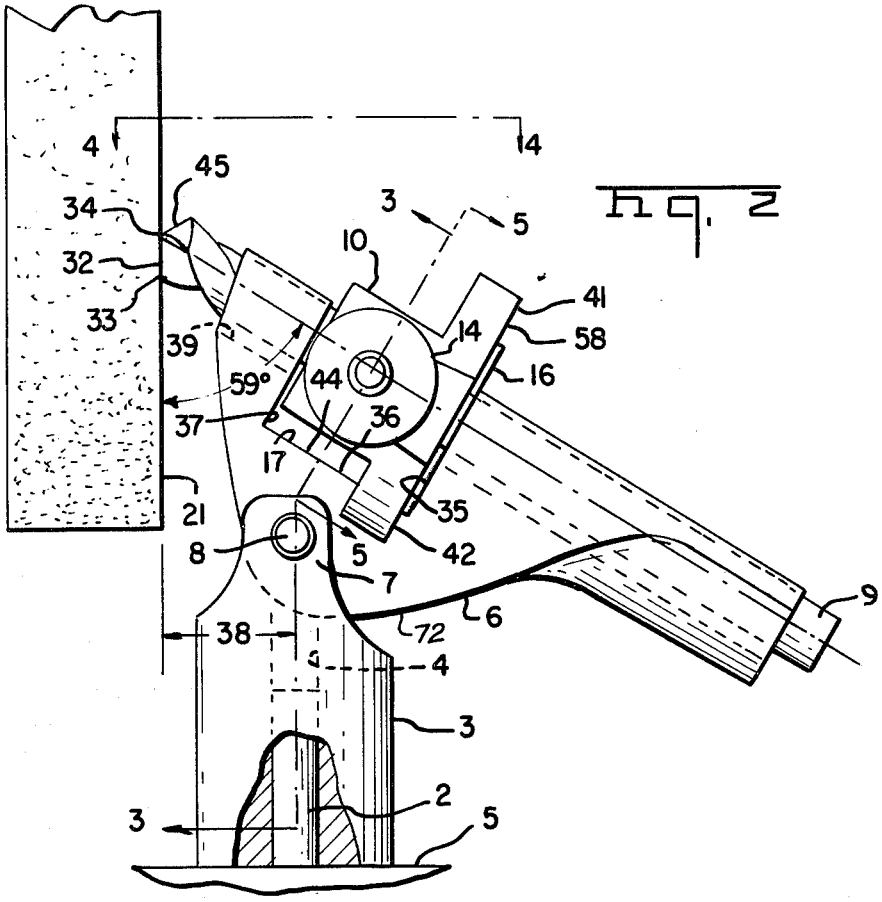
Fig. 2
Fig. 3
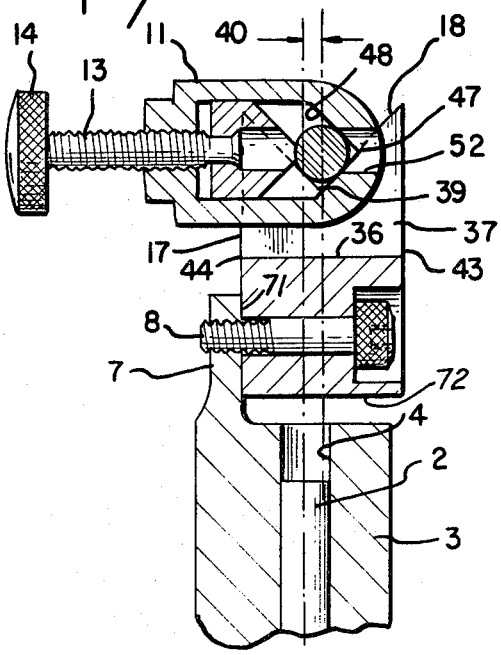
Fig. 4
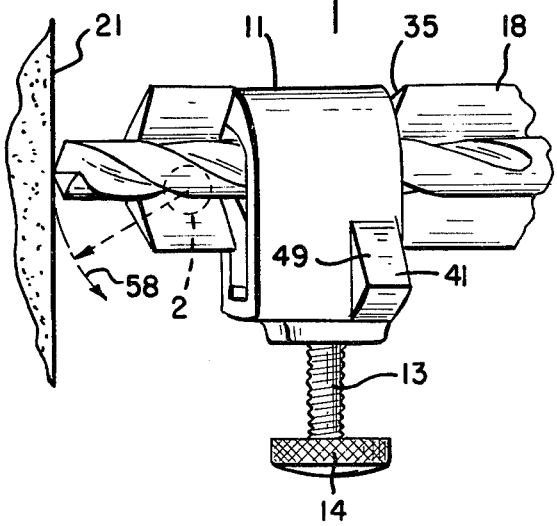

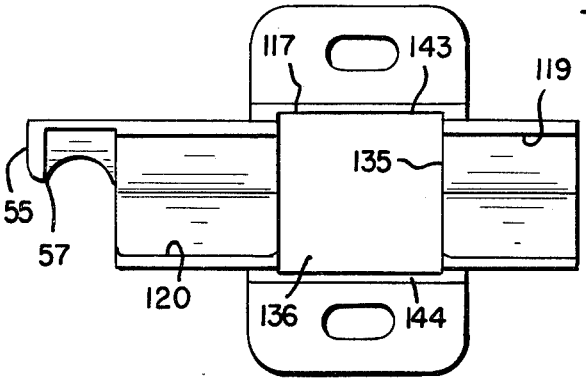
Fig. 7
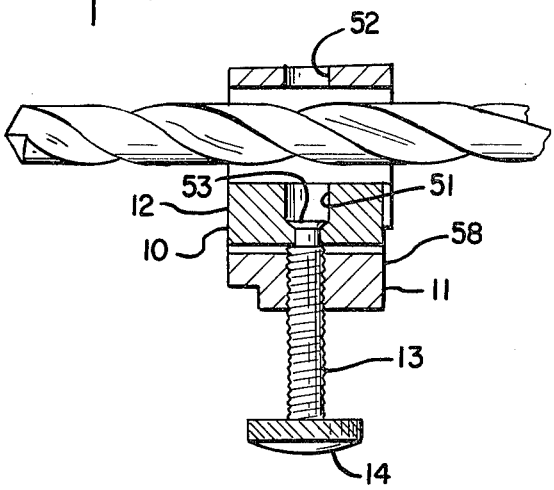
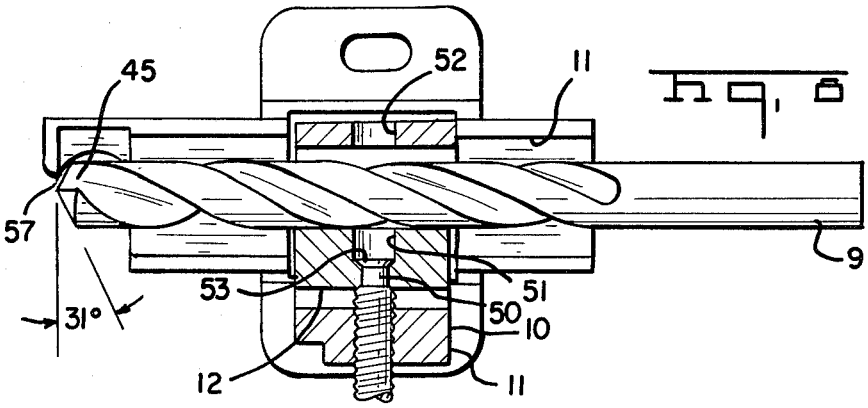
Fig. 8
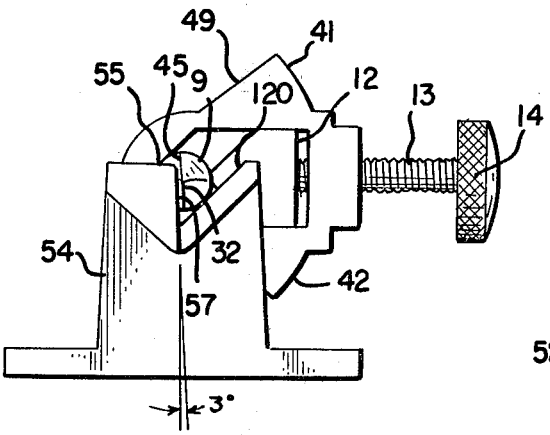
Fig. 9
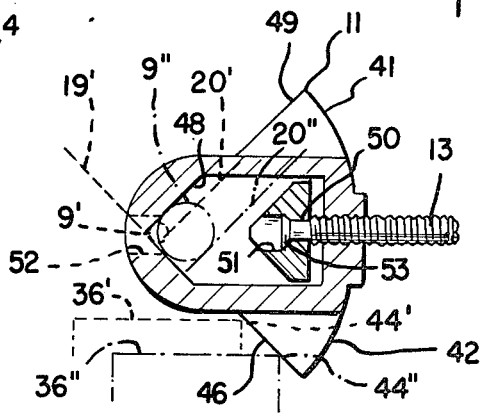
Fig. 9

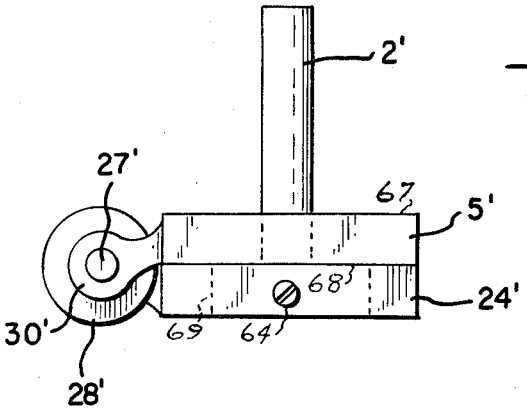
Fig. 11
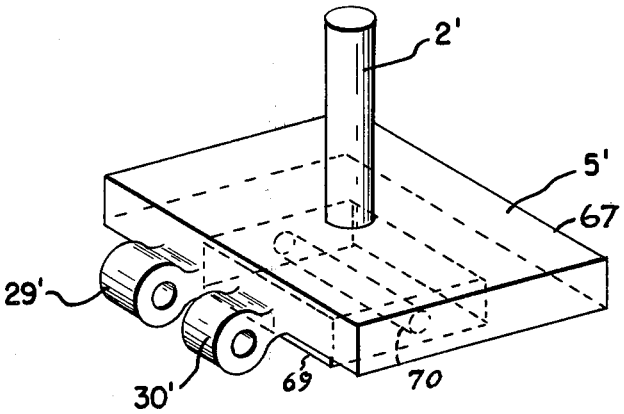
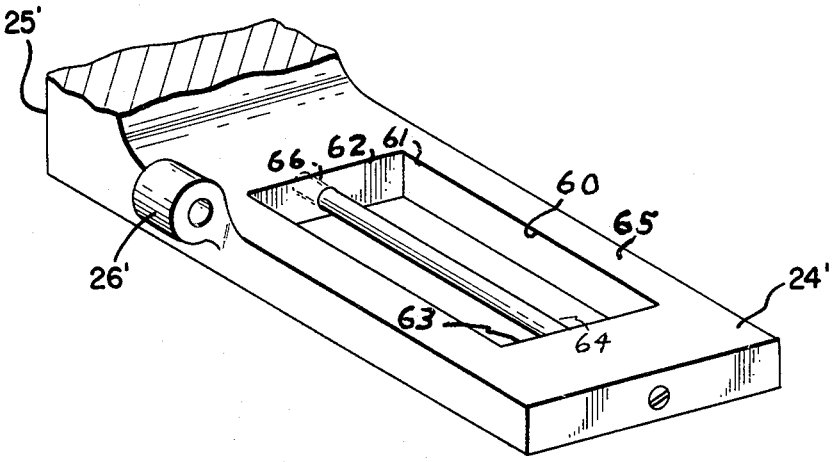
Fig. 10

DRILL GRINDING FIXTURE

BACKGROUND OF THE INVENTION

Drill grinding fixtures heretofore known have tended to be complex, expensive and difficult to adjust, or inexpensive and incapable of precision sharpening of drills, or so arranged as to produce other than the most desired cutting lip surface.

SUMMARY OF THE INVENTION

The invention provides a drill grinding fixture which is sturdy, inexpensive to produce, requiring minimal complex machining, embodying only a few simple parts, simply and rapidly operable and easily set up for each drill to be sharpened, useable with a wide range of grinders of common construction, and so arranged that operators having minimal skill can quickly and surely sharpen drills with cutting lips accurately ground to the proper shape, and, particularly, with identical cutting lips and the bit end being perfectly symmetrical.

The objects of the invention are the incorporation into a drill grinding fixture of the aforesaid attributes. These and other such attributes and objects of the invention will be apparent to those skilled in the art from the following description taken in connection with the accompanying drawings, in which:

FIG. 2 is a side elevational view of the fixture of FIG. 1, partially broken away and in section, and showing a drill in position for grinding on a wheel, represented in fragment;

FIG. 3 is a sectional view taken along line 3—3 of FIG. 2;

FIG. 4 is a sectional view taken along line 4—4 of FIG. 2;

FIG. 5 is a sectional view taken along line 5—5 of FIG. 2 with certain parts represented in phantom and showing relationships with drills of different sizes;

FIG. 7 is an exploded top view of the drill holding clamp assembly shown partially in section, with a drill extending through the clamp body, and of the alignment jig of FIG. 6;

FIG. 8 is a top view of the elements of FIG. 7 in assembled position with the drill clamped in the clamp assembly;

FIG. 9 is an end elevational view of the assembly as shown in FIG. 8;

FIG. 10 is an exploded perspective view, partially broken away, of a modified base portion of the drill grinding fixture, certain elements being omitted for clarity; and FIG. 11 is an end elevational view of the modified base portion of FIG. 10.

Figure 1:
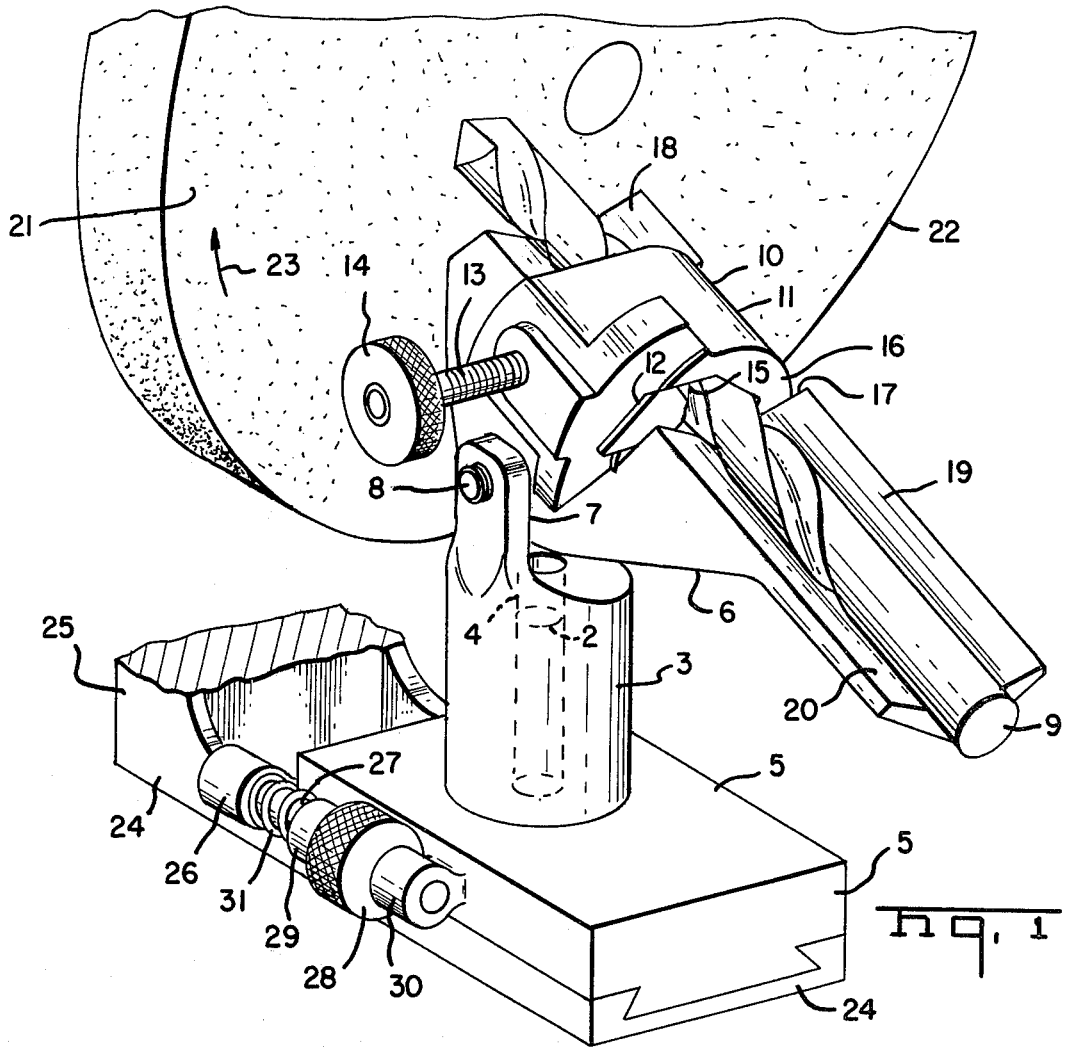
FIG. 1 is a perspective view of a drill grinding fixture embodying the invention, a portion of the mounting for the fixture being broken away and certain parts being indicated by broken lines, and showing a fragment of a grinding wheel and a drill in position on the fixture for grinding against the wheel.
Figure 6:
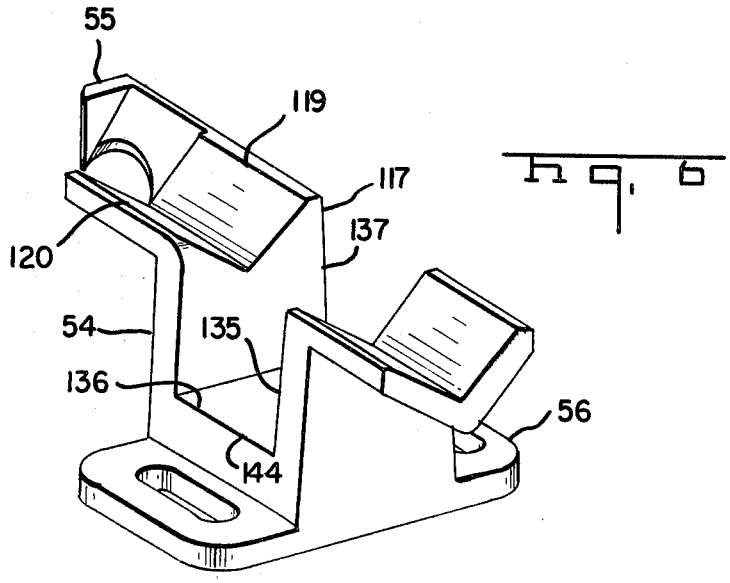
FIG. 6 is a perspective view of an alignment jig useful with the fixture of the invention.

As seen in FIG. 1 the drill grinding fixture comprises a base assembly 1 mounting a vertically upstanding cylindrical pin 2, shown in broken lines. A trough support member 3 is provided with a bore 4, indicated by broken lines, which receives pin 2 upwardly therein, whereby the support member 3 may freely rotate on the horizontal base portion 5 about the vertical axis of the pin 2. Member 3 carries a trough member 6, which is fixed by support member boss 7 and a bolt 8 to the rotatable support member 3. The trough member may be permanently fixed to the support member at an angle of inclination of the trough member of 31 degrees to the horizontal, whereby a drill 9 will be ground to have an included angle between its cutting lips of 118 degrees, and, to this end, the trough member may be formed together with mounting member 3 as a single integral casting. In the construction as shown, however, by slightly loosening bolt 8, the trough member may be adjusted about the horizontal bolt axis to an angle to be horizontal which is less than 31 degrees to grind drills for drilling stainless steel or to a greater angle to grind drills for drilling plastic materials, for example.

As seen in FIGS. 1 and 3, the boss 7 has a vertical inner face 71 offset from the axis of pin 2 by a predetermined distance against which a side face of the lower body portion 72 of the trough member is engaged, with bolt 8 passing through portion 72 and threaded into the boss. These engaged faces are closer by one-eighth inch to the pin axis than to the bottom of the groove of the trough member, and, for example, the distance between the vertical plane of the engaged faces and the pin axis may be three-eighths of an inch and from that plane to a vertical plane through the groove bottom may be one-half inch.

The fixture further comprises a drill holding clamp assembly 10 consisting of a body member 11, a moveable jaw 12 and a jaw-moving screw 13 provided with a manually engageable screw head or knob 14, preferablly knurled as shown. As hereinafter more fully appears, jaw 12 is so carried by screw 13 as to be moveable by the screw laterally toward and away from a drill 9 which is disposed in aperture 15 of body 11.

The rear face 16 of body 11 conforms to one of the faces defining a generally rectilinear recess 17 in the trough member into which body 11 is received. With a drill 9 clamped in the body 11 and extending forwardly and rearwardly therefrom, the extending portions of the drill rest in the V-shaped groove or trough 18 defined between the upwardly and outwardly extending divergent walls 19 and 20, supporting the body 11 and permitting the body 11 and the drill to be rocked about the drill axis, from a position in which one cutting lip may be ground, through 180 degrees thus to be in position for grinding the other cutting lip.

The base assembly 1 is arranged to permit the vertical pin 2 to be moved perpendicularly toward and away from the vertical grinding surface 21 of the grinding wheel 22. The grinding wheel is arranged to be driven in the direction of arrow 23 by being mounted on the shaft of a bolted down motor, for example, or by other well known means (not shown). The bottom plate or base member 24 of assembly 1 is fixed with respect to the grinding wheel such as by being screwed, bolted or clamped to the same surface on which the grinder motor is rigidly mounted, or by being bolted by an upstanding arm portion 25 directly to the motor housing. Fixed base plate 24 carries the base portion 5 by a dovetail slide 26, the slide and base plate being oriented to permit portion 5, carrying pin 2, to move perpendicularly toward and away from the grinding surface of wheel 22. A boss 26 unitary with plate 24 fixedly carries a bolt 27 extending horizontally alongside slideable base portion 5, and a knurled nut 28 threadedly engaged on bolt 27 is caged between bosses 29 and 30 which are unitary with base portion 5. Bosses 29 and 30 are caused to traverse bolt 27 in response to manual rotation of nut 28, thereby to advance base portion 5 toward, and to back the portion 5 away from, the grinding surface. A compression spring 31 is preferrably disposed around bolt 27 between boss 26 and boss 29 to urge boss 29 into firm engagement with nut 28, thus to insure against any backing away of portion 5 in response to forces of the wheel against the drill and to remove any slack in this drill advancing mechanism.

The fixture is seen in FIGS. 2, 3, and 4 arranged for grinding or sharpening a drill 9. The trough member 6 is inclined at 59 degrees to the vertical and drill 9 is nested in the V-shaped trough 18. The clamp body member 11 has been previously set in proper position on and firmly clamped to the drill with the lower cutting lip 32 of the drill very nearly vertical but, preferrably, inclined by about 2 or 3 degrees from the vertical in the cutting direction of the drill. Thus the lower end 33 of the cutting lip or cutting edge of the drill 9, as seen in FIG. 3, will be slightly closer to the viewer than the upper end 34, where lip or edge 32 meets the tip of the drill, the drill being a double-fluted right hand metal twist drill.

The body 11 is formed to have a rear face 16 which is perpendicular to the drill axis and which fits flat against the rear, or forwardly facing wall 35 which, in part, defines recess 17 in the trough member. The recess 17 is preferably rectilinear, is defined by a flat bottom wall 36 and a flat front wall 37, in addition to rear wall 35, and this recess interrupts the otherwise continuous trough or groove 18.

The pin 2 is adjusted into a position in which the distance 38 between the plane of the grinding surface and the axis of the pin is between about one-half and three-quarters of an inch.

It will be seen that the bottom 39 of the V-groove 18, and therefore the axis of the drill 9, is offset to the right (when looking forwardly from the rear of the fixture, in the viewing direction of FIG. 3) of the axis of pin 2 about which the trough member rotates during the grinding of each lip of the drill in turn. Such offset distance, indicated at 40 in FIG. 3, is, according to the invention, substantially one-eighth inch.

The clamp body 11 is intergrally provided with outwardly extending ears or tabs 41 and 42 of which the under surfaces serve as rotation stops, tab 41 being arranged to contact the shoulder 43 at one edge of the bottom wall 36 when one of the cutting lips of the drill is in position for sharpening and tab 42 being arranged to contact the shoulder 44 at the opposite edge of the bottom wall when the other cutting lip is in position for sharpening. As shown in FIGS. 1 through 4, tab 42 is in contact with shoulder 44, with drill lip 32 in position for grinding. Following the grinding of that lip, clamp assembly 10 is flopped over, or rocked, rotating about the axis of the drill, and with the drill rotating in the trough, through 180 degrees and into position to locate lip 45 for grinding.

When the nut 28 has been appropriately adjusted, the drill and clamp are manually held in position in the trough member and the trough member is manually slowly rotated on pin 2 in the direction of arrow 58 as seen in FIG. 4. Following the sharpening of the one lip of the drill, the drill clamp is manually flopped over into its opposite position, so that screw 13 extends to the right instead of to the left, and the trough member is again rotated in the direction of arrow 58, thus to complete the sharpening or grinding operation.

Referring to FIG. 5, clamp body 11 is shown as holding drills of different sizes and with phantom indications of the bottom wall and the groove walls to demonstrate the functions of the tabs 41 and 42. With a small diameter drill 9' nested in the bottom of the groove or trough between the groove walls 19' and 20', the bottom wall 36' and shoulder 44' all as shown in dotted lines, will assume the relative positions indicated with the body 11 rocked into the position shown in FIGS. 1–4. The stop wall portion of tab 42 is inclined outwardly form body 11 at 45 degrees with respect to the center plane of the clamp assembly, that is, the plane which would include the axes of the screw 13 and of a drill disposed in the clamp, and which would also include the intersection 47 of the drill-engaging inner side walls 48 of the body 11. The inner side walls 48 are outwardly inclined at 90 degrees to each other, and at 45 degrees to such center plane, and the inner walls 19 and 20 of the groove are at 90 degrees to each other and at 45 degree angles to a plane through the bottom of the trough 18, which plane would be vertical in this view. It will be noted that the center plane of the clamp assembly is horizontal in the view of FIG. 5, a view taken perpendicularly to the center line of the trough and to the axis of a drill in the trough, generally along line 5—5 of FIG. 1. When the clamp assembly with either size of drill, i.e. drill 9' or drill 9'', is rocked about the drill axis until the stop wall portion 49 of tab 41 engages the shoulder at the position seen at 43', in the case of the smaller diameter drill 9', or the shoulder at the position 43'', in the case of the larger diameter drill 9'', the body 11 and the drill will have rotated through exactly 180 degrees and, again, the central plane of the clamp assembly will be horizontal. In order for this result to be achieved, it is necessary that the surfaces 46 and 49 be parallel to the respective inner side walls 48 of the clamp body, that is, in this case, at 90 degrees to each other.

The method of fabricating the clamp assembly is best understood with reference to FIGS. 7 and 8. The screw 13 comprises a reduced diameter end portion 50 which enters into the enlarged counterbore 51 of the jaw 12, where, by means of a tool inserted through an aligned cylindrical opening 52 in clamp body member 11, such end portion is upset to form a mushroom head 53 on the screw.

A drill to be ground is first positioned in the clamp assembly by the use of a jig or gauge 54 as shown in FIGS. 6, 7, 8, and 9. The jig, in general, constitutes a replica of the trough member 6, except that it is provided with a lip portion 55 extending transversely partially across the forward end of the trough. Thus the jig comprises trough or groove walls 119 and 120 interrupted by a recess 117 defined between a rear wall 135, a bottom wall 136 terminating laterally outwardly at shoulders 143 and 144, and a front wall 137, all proportioned and arranged to accord with the similarly numbered elements of the trough member 6. The jig, however, is provided with a base 56 on which the jig rests.

The drill 9 to be ground is, as shown in FIG. 7, inserted through the body member 11 with the jaw open and the drill and clamp assembly 10 are placed in the jig, the drill lying in the trough and supporting the clamp assembly. The drill is slid forwardly and rotated by the fingers until, as seen in FIGS. 8 and 9, one of the cutting edges such as the edge of lip 32, is parallel to the sharp reference edge 57 of the jig lip portion 55 and the drill lip 32 is engaged with jig lip 55. The clamp body being now positioned to engage stop wall portion 46 with shoulder 144, and with the rear face 15 of the clamp body firmly engaged with rear wall 135, the screw 13 is tightened to close the jaw and clamp the the drill in the clamp assembly 10. The distance from the rear wall 135 of the recess in the jig to the lip portion 55 is such that, when the clamp assembly has been so set on the drill, the clamp assembly and drill are removed from the jig and are placed in the trough member of the fixture and the drill will now be in position for grinding, then requiring only minor adjustment of nut 28 to set the fixture for the desired light or heavy grinding depending upon the condition of the drill lips.

It will be noted from FIG. 9 that reference edge 57 is slightly inclined from the vertical and preferably extends upwardly to the left as viewed in this figure at approximately 3 degrees from the vertical. The result is that, as the trough member is swung on the axis of pin 2 in the direction of arrow 58, the vertical axis of the cylindrical surface produced on the end surface of the drill by the grinding wheel is inclined at 3 degrees from the cutting edge of the lip 32 being ground, providing slightly greater relief behind the lower end 33 than elsewhere along the cutting edge 32.

It will be noted that the rear face 16 of the clamp body member is slightly relieved in the vicinity of the tabs 41 and 42 as seen at 58 to provide optimum seating against wall 35 and to insure against any longitudinal displacement of the drill when the clamp assembly is rotated to position first one and then the other lip for grinding, whereby the lips are identical when each has been ground by the wheel. For the same reason, jaw 12 terminates slightly forwardly of the rear face 16.

It is not contemplated that the setting of the clamp 10 on the drill 9 using the jig can be sufficiently precise as to permit a drill and clamp to be positioned on the trough member and the drill ground without any adjustment of the position of the trough member with respect to the grinding surface, and, while fine adjustment to bring the cutting end surfaces and cutting lip of the drill into appropriate contact with the wheel surface can be accomplished by tilting the trough member about the axis of bolt 8 by one or two degrees from the usually desired 59 degrees without thereby substantially affecting the drilling quality of the drill, it is preferable that adjustments be made by a mechanism for advancing, and retracting, pin 2 rectilinearly toward and away from the grinding surface, such as the mechanism including base portion 5 guidedly slideable on the bottom plate 24 and adjustable by nut 28 as desired.

The modified base assembly of the fixture shown in FIGS. 10 and 11 comprises a bottom plate or base member 24', which may be held in place as described for plate 24, and which slideably carries base portion 5' on which is mounted vertical pin 2'. Bottom plate 24' is provided with a rectangular opening 60 defined between vertical parallel side walls 61, a forward end wall 62, and a rear end wall 63, and longitudinal shaft 64 extends between the end walls parallel to the end walls and to the top horizontal face 65 of the plate member 24'. The shaft may be fixed in position by being screwed into the member 24' as seen in broken lines at 66.

The base portion 5', which, like base portion 5, has horizontal flat top and bottom faces 67 and 68, and which similarly carries vertical pin 2', includes a rectinlinear projection 69 from its lower or bottom face. The projection 69 fits, preferably with a close sliding fit, between, and is thus guided by, side walls 61, and the projection is further provided with a horizontal bore 70 closely slideably receiving shaft 64, thus to be additionally, or alternatively, guided thereby. As seen, the shaft is disposed at a level between the upper and lower faces of the bottom plate member 24', and the bore 70 is, of course, the same distance below the level of face 68 of portion 5' as the distance of shaft 64 below the level of face 65 of the base member 24'. The length of the projection 69 along the bore 70 is less than the distance between the end walls 62, 63 whereby the base portion 5' may slide horizontally forwardly and backwardly through a distance of about one-half to one inch on the bottom plate 24' in the direction determined by the guide means.

Bosses 26', 29' and 30', and nut 28', and bolt or stud 27', together with a spring (not shown) are provided for the elements of the modified base assembly corresponding to the similarly numbered corresponding elements of the earlier described embodiment of FIGS. 1 and 2, it being understood that each of the other elements identified by primed numerals in FIGS. 10 and 11 correspond, except as specifically noted, to the similarly numbered elements of the first embodiment.

While it is desirable that the base assembly, specifically the base portion 5 or 5', be oriented substantially perpendicularly to the grinding wheel surface, that is, so that the guided direction of sliding of the base portion is substantially perpendicular to such surface, and the pin 2 or 2' is moveable toward and away from the wheel surface in a direction perpendicular thereto, a misalignment in either direction in a horizontal plane of ten or fifteen degrees, or up to as much as forty-five degrees, will have the tolerable effect of only slightly changing the one-eighth inch offset, shown at 40 in FIG. 3. Thus, if the base assembly is thirty degrees from a perpendicular orientation with respect to the plane of the wheel, the offset would be reduced from 0.125 inches to 0.108 inches, or at forty-five degrees, it would be reduced to 0.0884 inches, a reduction of about 30% of the amount of the offset. While the optimum offset is substantially one-eighth inch, satisfactory bit end shapes will be produced with offsets less than one-eighth inch by as much as about 30%. According to the invention, therefore, it is necessary that the base be only generally or approximately perpendicular to the wheel surface, intending by such terms to include departures by as much as about 30 degrees and not more than 45 degrees from precise perpendicularity.

The guide means, which comprise the dovetail portions of members 5 and 24 of the base assembly of the first embodiment, or the pin 64 and bore 70, or the slideably engaged side walls of the projection 69 and of the opening 60, or both, of the modified embodiment of FIGS. 10 and 11, establish the "orientation" of the base assembly as referred to above, while the slideably engaged lower face of the base portion 5 or 5' and upper face of the bottom plate 24 or 24' cause such sliding of the base portion to be horizontal.

While the invention has been described with respect to certain specific embodiments, it will be appreciated that many modifications and changes may be made by those skilled in the art without departing from the spirit of the invention. It is intended, therefore, by the appended claims, to cover all such modifications and changes as fall within the true spirit and scope of the invention.

What is claimed as new and what it is desired to secure by Letters Patent of the United States is:

1. A drill grinding fixture for double fluted drills of between 1/16 and ½ inch in diameter and for use with a grinding disk having a vertical planar grinding face rotating about a horizontal axis, said fixture comprising a cylindrical pin, means for mounting said pin with its axis vertical and disposed between one-half and three-quarters of an inch in front of said face, a hub member provided with a cylindrical bearing bore for receiving said pin upwardly thereinto, a trough member having a forward end, a rearward end and an upwardly open rectilinear elongated V-shaped groove defined between diverging flat groove walls meeting along a linear groove bottom and extending from one to the other of said ends, said groove walls diverging at equal predetermined angles from a vertical plane through said linear bottom, such angles being measured in a plane perpendicular to said linear bottom, said trough member further comprising a planar face facing toward said forward end, disposed perpendicularly of said groove, and defining a recess of which said face constitutes the rearward wall and which recess interrupts said groove walls spacedly between said ends, said recess opening outwardly laterally of said trough member and being further defined by a laterally extending bottom wall perpendicular to said face and disposed lower than said groove bottom, said bottom wall terminating laterally of said trough member in respectively opposite shoulders located equidistant from the line defined by said linear bottom of said groove, a drill holding clamp assembly comprising a body member having a front face and a planar rear face and having a through opening between said faces extending perpendicularly of said rear face for receiving a drill therethrough with forward and rearward portions of such drill extending from said body, said body member being symmetrical about a central plan perpendicular to said rear face, said opening being defined by walls diverging upwardly from a meeting line in said center plane at angles thereto equal to said predetermined angles, said assembly further comprising screw means disposed in said central plane engaged in said body member and entering said opening opposite to said meeting line for releasably clamping such drill in a position wedged between said walls of said opening, said body member being receivable into said recess with said rear face in contact with said planar face of said trough member and said body member being rockable with, and about the axis of, a drill clamped therein by said screw means and with said forward and rearward portions of said drill seated in said groove, said body member including laterally outwardly extending positioning tabs having outwardly and downwardly facing respective divergent surfaces for meeting said respective shoulders, each said surface being parallel to the respective said wall of said opening on the same side of said plane, said trough member being disposed with the bottom of said groove offset to the right, viewed from a position rearwardly of said rearward end of said trough member, by substantially one-eighth of an inch from said vertical axis of said pin, and means for mounting said trough member on said hub member with said groove disposed at an angle of substantially 59 degrees to the vertical.

2. A drill grinding fixture for grinding double-fluted, right hand, metal twist drills against a vertical face of a rotating grinding wheel, comprising a base assembly including a bottom plate, a base portion slideably mounted on said bottom plate, and cooperative guide means on said plate and said portion for slideably guiding said base portion with respect to said plate in a predetermined horizontal direction, said plate being adapted to be fixed in a horizontal position to orient such guide means with said direction generally perpendicular to said face, said base portion comprising a horizontal upper face area, a vertical pin fixed to said base portion extending upwardly from said area and having an upper end, an upstanding support member having a bore receiving said pin and a lower end face supportingly bearing on said area, said support member being rotatable on said pin with respect to said base portion, said support member comprising an upper boss portion extending above said upper end of said pin and having a vertical inner face displaced laterally by a predetermined distance from the axis of said pin, a trough member comprising two walls diverging upwardly at 90 degrees to each other from a meeting line to define a groove having a bottom at said meeting line, said walls being at equal angles to a vertical plane through said line, said trough member further comprising a lowr body portion having a vertical side face displaced by a distance from said vertical plane through said meeting line which is substantially one-eighth of an inch greater than said predetermined distance, said trough member having a forward end adapted to be oriented toward said wheel face when grinding a drill and a rearward end, screw means between said boss and said trough member for retaining said boss face and said side face in contact to the left of said groove bottom as viewed from the rear of said trough member and for maintaining said trough member in an adjustable position of inclination thereon in which said line is inclined upwardly toward said forward end, said trough member further including a forwardly facing wall between said ends which is perpendicular to said line and which constitutes the rearward defining wall of a recess interrupting said divergent walls, said recess being further defined by a bottom wall extending laterally of said trough member below said line and terminating in opposite shoulders which are symmetrical with respect to said line and to said plane through said line, a clamp assembly comprising a body member having an opening therethrough defined by symmetrically diverging interior planar wall surfaces and an end wall perpendicular to said wall surfaces, said body member further comprising opposite outer side wall surfaces respectively parallel to the adjacent said interior wall surfaces, said clamp assembly further comprising drill clamping means moveable between said interior surfaces to clamp a drill therebetween, said body member being disposable in said recess with its said end wall in contact with said rearward wall of said recess and said body being rockable about the axis of a drill clamped in said body member and having extending portions lying in said groove to support said body member, said shoulders being located to be contacted by the respective said side wall surfaces when said body member so supported is rocked into positions in which a plane centered between said interior wall surfaces is perpendicular to said vertical plane through said line.

3. The combination according to claim 2 wherein the angle between said interior surfaces is 90 degrees.

4. The combination according to claim 2 wherein said body member comprises a portion opposite said interior wall surfaces and said drill clamping means comprise a jaw member and a screw threaded through said opposite portion and moveably mounting said jaw member between said interior surfaces.

* * * * *